US005752803A

United States Patent [19]

Wetzel et al.

[11] Patent Number: 5,752,803

[45] Date of Patent: May 19, 1998

[54] HIGH PRESSURE CENTRIFUGAL SLURRY PUMP

[75] Inventors: Gerald Albert Wetzel, Hazelton; Russell Schumack, Shenandoah, both of Pa.

[73] Assignee: Goulds Pumps, Incorporated, Fairport, N.Y.

[21] Appl. No.: 623,857

[22] Filed: Mar. 27, 1996

[51] Int. Cl.[6] ..... F04D 17/00

[52] U.S. Cl. ..... 415/182.1; 415/199.1; 415/200

[58] Field of Search ..... 415/196, 214.1, 415/197, 200, 199.1, 199.2, 199.3, 182.1

[56] References Cited

U.S. PATENT DOCUMENTS

| | | | |
|---|---|---|---|
| 3,238,881 | 3/1966 | Camac | 415/196 |
| 4,648,789 | 3/1987 | Bowman | 415/214.1 |
| 5,281,086 | 1/1994 | Wissmann et al. | 415/197 |
| 5,344,285 | 9/1994 | O'Sullivan et a. | 415/214.1 |
| 5,385,445 | 1/1995 | McKenna | 415/214.1 |
| 5,452,987 | 9/1995 | Bleger et al. | 415/214.1 |
| 5,513,954 | 5/1996 | Bourgeois | 415/196 |

FOREIGN PATENT DOCUMENTS

| | | | |
|---|---|---|---|
| 539148 | 4/1930 | Germany | 415/196 |
| 524315 | 10/1953 | Italy | 416/196 |
| 92399 | 7/1981 | Japan | 415/196 |

*Primary Examiner*—John T. Kwon
*Attorney, Agent, or Firm*—Brezina & Ehrlich

[57] ABSTRACT

A high pressure centrifugal slurry pump in which the impellers and their associated diffusers are formed of hard chrome iron. A liquid-tight high pressure containment shell surrounds the impellers and diffusers and is radially spaced from them. The resulting space between the array of impellers and diffusers and the containment shell is in fluid communication with the interiors of the impellers and diffusers, preferably through a channel located between the last diffuser of the pump and the end wall at the high pressure end of the pumping chamber.

16 Claims, 5 Drawing Sheets

75
108
109
106
140
111
7

HIGH PRESSURE CENTRIFUGAL SLURRY PUMP

FIELD OF THE INVENTION

The present invention relates generally to a centrifugal pump, and in particular to a pump for use in high pressure pumping of a slurry containing a large quantity of abrasive particles.

BACKGROUND OF THE INVENTION

When centrifugal pumps are used for dewatering mines, for pumping water from wells, and for other similar purposes, the liquid being pumped usually contains sand, gravel and small stones. Over time, such abrasive-containing slurries can have a serious scoring, chipping, cracking or other damaging effect on the internal parts of the pump that come into contact with heavy abrasives contained in the liquid.

In addition, the abrasive materials may sometimes cause the pump to lock up and prevent the motor from starting, or even cause it to stall. This may occur, for example, if abrasives become permanently entrapped in the seal between the rotating impeller and the stationary diffuser in one of the stages of the pump.

These problems are increased when the pump operates at a high pressure. A pump used for dewatering a mine, for example, may be operated at a pressure of 43 atmospheres of pressure, or even higher.

Centrifugal pumps used for the indicated purposes are commonly multi-stage pumps. A multi-stage centrifugal pump comprises a pumping chamber that contains a plurality of stages, or modular pumping units, assembled in a series that extends along the pump shaft, each of which pumping units includes a rotatably mounted impeller having a plurality of vanes or blades arranged to direct the liquid outward and into a stationary diffuser. The diffuser is configured to reduce the turbulence and velocity of the liquid as it flows from the impeller, and at the same time to increase the static pressure of the liquid. The diffuser, which may be a single member or may comprise an initial portion and a return member, is configured to direct the liquid to the inlet opening or "eye" of the next adjacent pumping unit of the series of units, or to the discharge opening of the pump, as the case may be.

In operation, each of the modular pumping units in a multi-stage centrifugal pump forms a separate pumping stage. Each stage receives liquid at a certain pressure, further pressurizes the liquid, and directs it either to the next stage or to the outlet at the discharge end of the pump. To prevent leakage or recirculation of the liquid back to a lower pressure stage, each modular pumping unit is commonly sealed with the members adjacent to it, about its inner and outer peripheries. In the case of the first pumping unit in the series, the seals on the low pressure side are with the inner surface of the end wall at the low pressure end of the pumping chamber. Each unit of the series is sealed with the rear surface of the preceding unit. The last of the series of pumping units is sealed, in a conventional centrifugal pump, with the inner surface of the end wall at the high pressure end of the chamber.

In conventional multi-stage centrifugal pumps, the parts that come into contact with the liquid being pumped are formed of cast iron, bronze or stainless steel. The use of such materials for the pump parts permits the assembled parts to be subjected to higher and higher internal liquid pressure as the liquid moves through the successive modular units that extend along the pump shaft. However, cast iron, bronze and stainless steel have not been found to be hard enough that their surfaces will resist the type of damage that, as explained above, often results when the liquid being pumped contains large quantities of abrasive particles.

Some 25 years ago, pump manufacturers began limited use of hard chrome iron for internal pump parts, in order to provide higher wear resistance than cast iron, bronze or stainless steel provide when used in centrifugal pumps. So far as wear resistance alone is concerned, hard chrome iron has been found to be an excellent material from which to manufacture impellers, diffusers, casings, suction liners and other internal parts of a centrifugal pump that is used for liquids containing high levels of abrasive particles.

However, prior to the present invention such use of hard chrome iron has not been at all satisfactory overall in high pressure pumps, because it has inevitably carried with it one very serious disadvantage. Specifically, high chrome iron is so brittle that under heavy tensile stress it tends to crack and rupture. Thus, if it is used for the internal parts of a conventional high pressure centrifugal pump, the parts in question—especially the diffusers—must be made with such thick, bulky walls as not to be either practical or cost-effective. In fact, it is believed that hard chrome iron has been used commercially only for single-stage pumps, because of the cumulative affect that such bulky walls would have in a multi-stage centrifugal pump.

As just indicated, hard chrome iron has been used for the internal parts of some lower pressure centrifugal pumps for at least 25 years. However, so far as is known, over the 25 or more years that hard chrome iron has been available to skilled workers in the art, the use of a high pressure containment shell in order to make the use of hard chrome iron for internal parts of a high pressure pump practical and cost-effective has never been considered or believed to be possible.

SUMMARY OF THE INVENTION

The present invention relates to both single stage and multi-stage centrifugal pumps, but for convenience it will be described here and in the other sections of the specification primarily in terms of the multi-stage embodiment.

In a multi-stage centrifugal pump according to this invention, the pump shaft and a series of impellers secured to the shaft are rotated within a generally cylindrical pumping chamber, which also contains an equal number of stationary diffusers. Each impeller and its associated diffuser behind it comprise a separate modular unit or stage.

The impellers and their associated diffusers are formed of hard chrome iron. A protective liner preferably extends around the inlet opening in the low pressure end of the pumping chamber, and is also formed of hard chrome iron.

A liquid-tight high pressure containment shell surrounds the pumping chamber and is radially spaced from the chamber. The resulting space between the array of impellers and diffusers and the containment shell is in fluid communication with the interiors of the modular pumping units, advantageously at a location at least the greater part of the distance along the flow path through the pumping units from the inlet opening of the first unit of the series to the discharge opening in the pumping chamber end wall. In some cases the communication may be directly through an exterior wall of one of the modular pumping units, but it preferably extends from the space immediately outside the outlet of the last pumping unit in the series of units, through an intermediate channel or channels between the last diffuser of the series and the end wall of the pumping chamber at the high pressure end of the chamber, to the space immediately inside the shell.

Whatever path it takes, the liquid from the interiors of the modular pumping units fills the space in question. This high pressure liquid, confined by the containment shell, opposes the outwardly directed pressure from within the interiors of the impellers and diffusers. It thereby reduces, or avoids altogether, the tensile stress to which the hard chrome iron parts of the pump, especially the return portion of the diffuser, would otherwise be subjected.

ADVANTAGES OF THE INVENTION

The centrifugal pump of this invention utilizes the hardness and wear resistance of hard chrome iron in those parts of the centrifugal pump—impellers, diffusers, and protective linings—that are unavoidably subject to the possibility of very serious damage when a slurry containing a quantity of abrasive particles is being pumped.

The use of a high pressure containment shell as described above makes it possible to fabricate various internal parts of a high pressure slurry pump from hard chrome iron without having to make the parts so thick as to be impractical as a physical matter and prohibitively expensive, as has heretofore been the case with pumps using such materials.

DETAILED DESCRIPTION OF PREFERRED EMBODIMENT

A detailed description of a preferred embodiment of the centrifugal pump of this invention will now be provided by reference to the accompanying drawings.

General Construction

Figure 1:
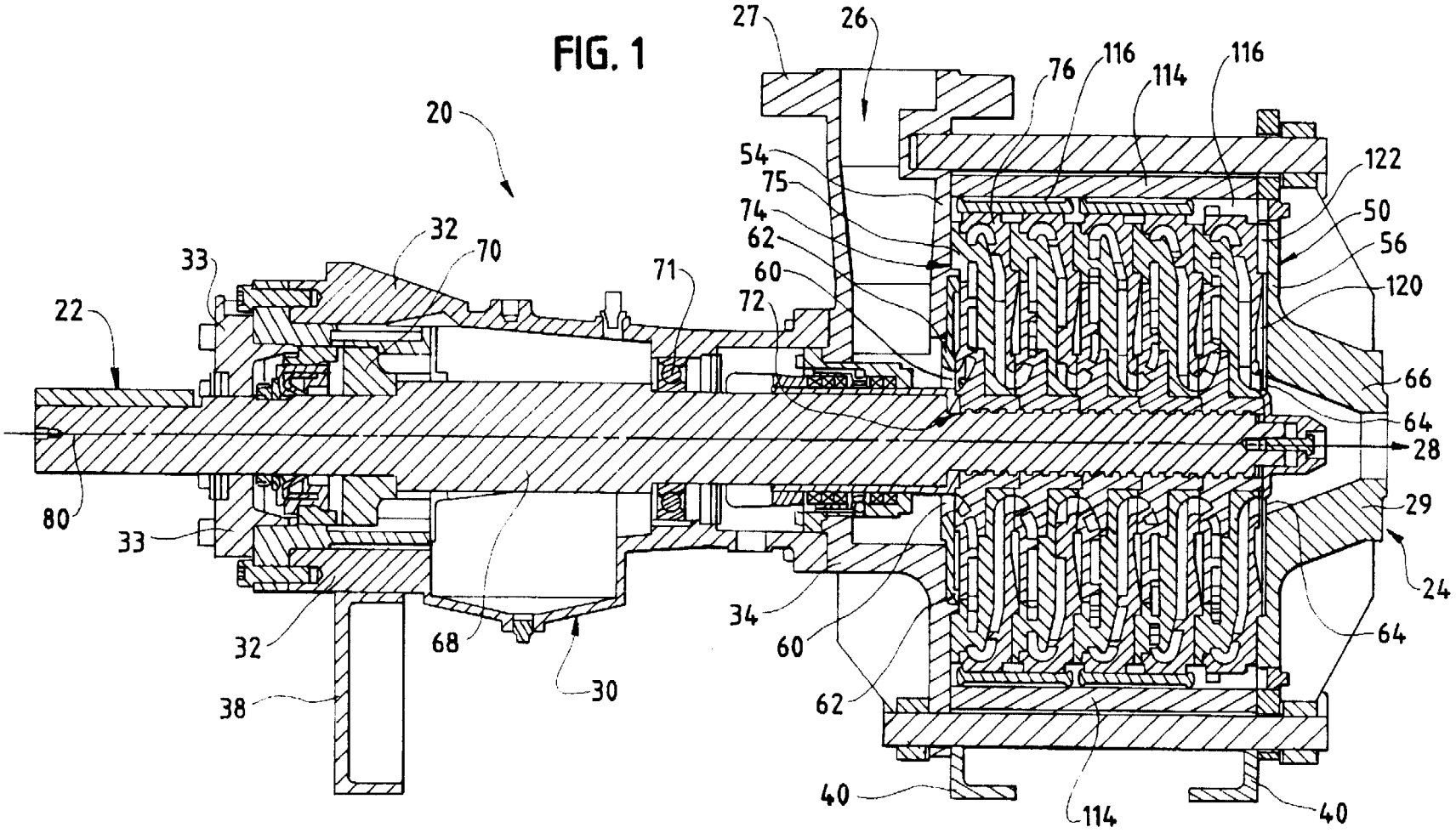
FIG. 1 is a vertical cross section of one embodiment of a multi-stage centrifugal pump according to this invention, taken along a longitudinal vertical plane.

FIG. 1 is a vertical cross section of a preferred embodiment of a multi-stage centrifugal pump 20 according to this invention, for use in pumping liquid that contains large quantities of abrasive materials such as sand, gravel and small stones. The pump is shown from its motor end 22 on the left to its liquid end 24 on the right. The liquid or slurry being pumped is introduced at inlet opening 26 in suction head 27, and exits under greatly increased pressure at discharge opening 28 in discharge head 29.

The support frame for the pump is comprised of various parts, including among others casing 32, and end members 33 and 34, all supported by legs 38 and 40. As shown in FIG. 1, generally cylindrical pumping chamber 50 is mounted on support frame 30. Pumping chamber 50 includes low pressure end wall 54 and high pressure end wall 56. Low pressure end wall 54 defines annular inlet opening 60 for introduction into the pumping chamber of liquid entering inlet 26. Suction liner or protective liner 62 surrounds the annular inlet opening. High pressure end wall 56 defines discharge opening 64, which communicates with discharge opening 28 in the discharge head.

In the embodiment shown in FIG. 1, pump shaft 68 is rotatably mounted in support frame 30 by means of two bearings within the frame, 70 on the left and 71 on the right. In turn, impellers 72 are supported by shaft 68. Both bearings 70 and 71 are external to pumping chamber 50. One portion of the pump shaft is positioned within the pumping chamber, and one portion extends from the chamber and terminates in power end 80. The drive shaft of a motor (not shown) is operatively connected to the power end of the pump shaft.

As a result of this arrangement of parts, the liquid end of shaft 68 and the impellers attached to it are cantilevered to the right in FIG. 1 by bearings 70 and 71. The advantage to this cantilevered construction is explained in my application for patent filed simultaneously herewith entitled "Cantilevered High Pressure Multi-Stage Centrifugal Pump." It is to be understood, of course, that the present invention is not limited to the particular construction that is shown in FIG. 1 and described herein. The combination of the use of hard chrome iron internal parts with the high pressure containment shell (both fully described below) can be employed in any centrifugal pump.

Impellers and Diffusers

Rotatable centrifugal impellers 72 are secured to pump shaft 68. Diffusers 74, each comprised of first diffuser member 75 and return member 76, are fixedly mounted within pumping chamber 50 in five stages from left to right in FIG. 1. Each stage comprises a modular pumping unit containing the members just mentioned.

Impellers 72 and diffusers 74 are formed of hard chrome iron, which is cast iron that has been alloyed principally with chromium to secure high resistance to abrasive wear. Suction liner 62 is also preferably formed of the same high resistance material.

A typical formulation for the alloyed hard chrome iron used in this invention is as follows:

| | Percent |
|---|---|
| Carbon | 2.3–3.0 |
| Copper, Max. | 1.2 |
| Magnanese | 0.5—1.50 |
| Silicon, Max. | 1.0 |
| Phosphorus, Max | 0.10 |
| Sulfur, Max. | 0.06 |

-continued

| | Percent |
|---|---|
| Chromium | 23.0–28.0 |
| Nickel, Max | 1.5 |
| Molybdenum, Max. | 1.5 |
| Balance | Essentially Iron |

Hard chrome iron alloys containing lower amounts of chromium can also be used, although with limited advantage, in the centrifugal pump of this invention.

Figure 2:
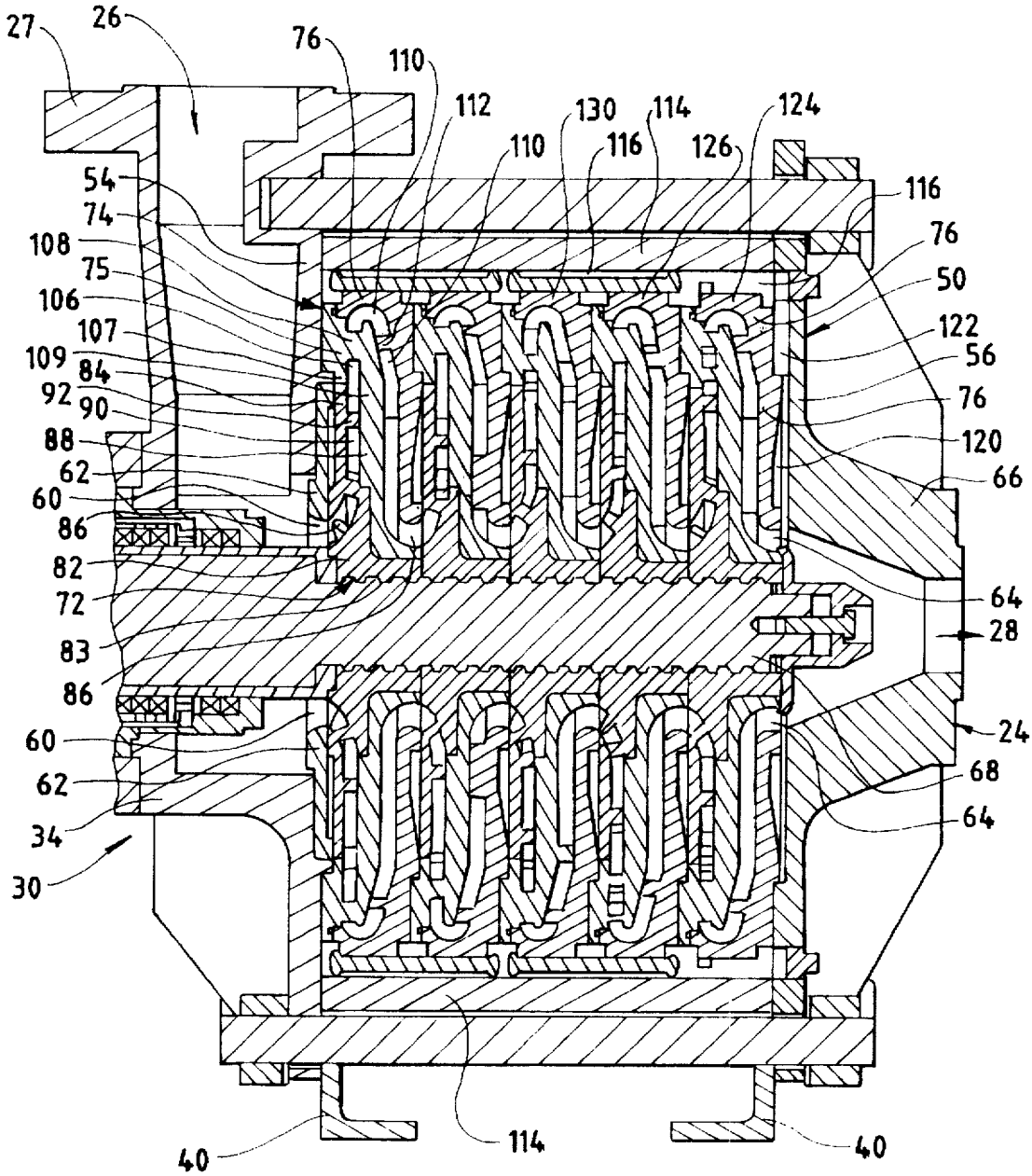
FIG. 2 is a similar but enlarged view of the liquid end of the centrifugal pump of FIG. 1.

The arrangement of an impeller and diffuser within each pumping unit is illustrated in FIG. 2, which is an enlarged view of the liquid end of the pump of FIG. 1. The pumping unit in the first stage of the pump is (except for its relationship to the end wall at the low pressure end of the chamber) typical of the other pumping units.

Impeller 72 in the first stage of the pump has a hub 82 threadably secured to the pump shaft at 83 to rotate with the shaft. Circular front wall 84 extends outward from the hub and defines central opening, or eye, 86 adjacent the hub. Circular rear shroud 88 is spaced axially from front wall 84 and extends outward from the hub. In the embodiments shown in FIGS. 1 and 2, the diameter of the rear shroud of each of the impellers is substantially less than the diameter of the front wall, and the vanes that define the impeller passages (discussed below) extend—for the purpose described in my application for patent filed simultaneously herewith entitled "Centrifugal Pump Closed Impeller"—substantially to the outer perimeter of the front wall.

Impeller passages 90 are located between front wall 84 and rear shroud 88 in fluid communication with central opening 86 of impeller 72. The passages are formed by vanes 92 that spiral outward toward the outer periphery of the impeller in the direction of rotation of the pump shaft. As a result of this configuration of the passages, liquid exits from the passages at a greater velocity and pressure than the velocity and pressure at which it entered.

Diffuser 74 is fixedly mounted within pumping chamber 50. In the embodiment of FIGS. 1 and 2, the diffuser includes a first member 75 and a separate return member 76. The return member is located on the rear side of first diffuser member 75. All the diffuser first members 75 and return members 76 are in this embodiment secured in face-to-face relationship by connector bolts operatively connected with the high pressure and low pressure end walls of the pumping chamber.

First diffuser member 75 includes a plurality of diffuser passages 106. These diffuser passages are formed by a plurality of vanes 108 that spiral inward toward the inner portion of the diffuser and in the direction of rotation of the pump shaft. This configuration provides the first step in directing liquid inward from the outer periphery of the pumping unit.

Return member 76 includes a plurality of diffuser passages 110. These passages are formed by a plurality of vanes 112 that spiral inward toward the inner portion of the diffuser and in the direction of rotation of the pump shaft.

As will be seen, impeller passages 90 and diffuser passages 106 and 110 are all in fluid communication. The liquid being pumped exits from diffuser passages 110 at a lower velocity and higher pressure than the velocity and pressure at which the liquid exited from impeller passages 90.

Each return except the return in the last of the series of pumping units is configured to direct the liquid passing through the diffuser to the central inlet opening 86 in the impeller of the next succeeding pumping unit. The return in the last pumping unit in the series is configured to direct the liquid from the diffuser to discharge opening 64 in pumping chamber end wall 56.

As shown in FIGS. 1 and 2, the generally cylindrical portion of the pumping chamber is formed by the outer portions of first diffuser members 75 and return members 76. These members are all in close face-to-face contact with each other, and the assembled parts are in contact with low pressure end wall 54 of the pumping chamber and with a portion of end wall 56 at the other end of the chamber.

Use of the present invention is not limited to the particular embodiment illustrated in FIG. 1. Among other things, the invention can be employed with centrifugal pumps that have only one stage instead of a plurality of stages. Likewise, the invention can be employed with any suitably constructed pumping chamber and pumping units within the chamber. As one example, if the series of pumping units in a multi-stage centrifugal pump are not contained in a chamber formed by the outer portions of abutting diffusers themselves (as in the embodiment of this invention illustrated in FIGS. 1 and 2), they may be contained in (1) a chamber formed by a series of separate, abutting, bowl-like members each of which houses an impeller and a diffuser, (2) in a chamber formed by a series of separate, abutting, shallow cylindrical shells, one for each impeller and its associated diffuser, or (3) in any other suitable construction that will house the pumping units reliably in uniformly aligned positions.

High Pressure Containment Shell

The present invention makes it possible to employ internal parts in a centrifugal slurry pump, for example, that are much harder than parts formed of conventional iron, bronze and stainless steel materials, and to do this in a practical and cost-effective way. In particular, the practice of this invention makes it possible to avoid the much thicker walls that have been necessary whenever hard chrome iron has been used in the past. In fact, the dimensions of these pump parts do not need to be any greater than in pumps using bronze, iron or stainless steel parts. This is achieved through use of a special containment shell positioned around the outside of the pumping chamber.

As will be seen from FIGS. 1 and 2, high pressure containment shell 114 surrounds the impellers and diffusers of all the pumping units. The shell has a liquid-tight connection with end wall 54 at the low pressure end of the pumping chamber and with end wall 56 at the high pressure end of the chamber. It is formed of a suitable ductile material such as steel or stainless steel.

Containment shell 114 is radially spaced from all the modular pumping units of this multi-stage pump. Space 116 between the pumping units and the containment shell has the general shape of a thin-walled hollow cylinder. This space is in fluid communication with the interiors of the modular pumping units of the pump, which causes a small amount of the liquid being pumped to be channeled into the space. It is this communication between the interiors of the pumping units and space 116 surrounding the pumping units and bounded by the containment shell that makes it possible to use hard chrome iron parts of only ordinary thickness in high pressure centrifugal pumps. As already indicated, this makes for a far less bulky pump, and a much less expensive pump, for a given level of performance.

As pointed out above, as the liquid being pumped moves from one modular pumping unit to the next, the pressure within the interiors of the units continues to increase until it is many times greater than the ambient atmospheric pressure. At the outer perimeter of the diffusers, this increased pressure is directly radially outward, which produces longitudinal tensile stress along the interior body of the return portion of the diffuser and, even more troublesome, circumferential tensile stress around the cylindrical outer wall portions of each return. It is this tensile stress that can produce cracking and rupturing of the very brittle hard chrome iron pump parts.

The channeling of liquid at high pressure from within the interior of the modular pumping units into space 116 brings a very high level of fluid pressure to bear on the containment shell, since it reflects the pressure in the interior of the pumping units of the pump. The containment shell resists this pressure, thus reducing, and in preferred embodiments of the invention eliminating altogether, the outwardly directed pressure on the pump parts just described.

In the preferred embodiments of this invention, when the outwardly directed pressure is opposed by the inward pressure from the containment shell, conveyed through the substantially incompressible liquid immediately inside the shell, the outward pressure is not only eliminated, but actually reversed, along the entire axial length of the pumping chamber. In other embodiments discussed below, the outwardly directed pressure is reversed for a substantial portion of the chamber length, and is substantially reduced for the remainder of the chamber length.

The reversal of the pressure in some or all parts of the pump chamber that is achieved by use of the containment shell will apply an inwardly directed pressure to the internal parts of the pump. No problem is presented by this reversal, since hard chrome iron parts resist compressive stress, as distinguished from tensile stress, very well.

Range of Hardness of Chrome Iron

The Brinell hardness number (BHN) that is required in the hard chrome iron used for internal pump parts depends on the media being pumped and the expected life of the pump. Exactly what the life of a pump will be with materials of a certain BHN will depend upon the liquid being pumped and what kind of solid particles it contains. In every case, however, use of hard chrome iron parts instead of parts formed of cast iron, bronze and the like will significantly extend pump life in abrasive services.

Some centrifugal pumps according to this invention will be used to pump liquids containing extremely hard and abrasive particles. In such pumps the impellers, diffusers and protective liners are preferably made of hard chrome iron having Brinell hardness numbers in the high upper ranges, as high as a BHN of about 600 or higher.

Hard chrome iron in this range is very brittle. Because of this, the offsetting inwardly directed pressure from the containment shell, transmitted by the liquid between it and the array of modular pumping units, should be as high as practicable. Therefore, when liquid containing extremely abrasive particles is to be pumped (which calls for very hard internal pump parts) it is preferred that cylindrical space 116 just inside the containment shell be in fluid communication with the interiors of the modular pumping units of the pump at the point where the pressure within the pump is at a maximum. For this reason, in FIGS. 1 and 2 space 116 is in fluid communication with the space immediately outside outlet 64 of the last pumping unit in the series, through a channel which comprises spaces 120 and 122.

Alternatively, very nearly the same level of pressure can be achieved in space 116 by blocking off the channel just referred to and providing small holes or slots in the wall of the last return member 76 at a location such as area 124 shown in FIG. 2, a location that is still rather close to the high pressure end of the pumping chamber.

In pumps designed for pumping liquids containing moderately abrasive particles, internal pump parts can be formed of hard chrome iron that has a BHN of at least about 400, a material which, although quite hard, is less brittle than the material referred to in the immediately preceding paragraphs. In such case, space 116 within the containment shell can be in fluid communication with the interiors of the modular pumping units through small holes or slots located in the vicinity of area 126 of return 76 in the next-to-last pumping unit of the series. In the embodiment shown in FIGS. 1 and 2, the area indicated is located at least about 70 percent of the total distance along the flow path through the pumping units.

With hard chrome iron that is still less brittle, the small holes or slots can be located instead in area 130 in the middle diffuser of the series, which area is located at least about 50 percent of the total distance along the flow path through the pumping units.

As will be seen, if holes or slots are provided as described in area 126, the pressure differential exerted on the outer wall of the first three diffusers in the series will be inwardly directed, and in the case of the fifth diffuser will be reduced in magnitude but outwardly directed. This will reverse the pressure otherwise imposed on the first three diffusers, and will reduce the pressure that would otherwise be imposed on the fifth diffuser if no containment shell were present. Depending upon the Brinell hardness number of the hard chrome iron used for the diffusers, this may provide adequate protection against possible damage to the internal pump parts caused by the brittle nature of hard chrome iron.

(It should be noted that areas 124, 126 and 128 are indicated in FIG. 2, although the holes or slots themselves are not shown.)

Form of Impellers and Diffusers

The embodiment of this invention illustrated in FIGS. 1 and 2 includes, as already explained, a novel combination of hard chrome iron internal parts and a containment shell as described. In addition, as has been noted, the cantilevered construction of the pump shaft and the configuration of the centrifugal impellers are novel and are the subject of copending applications. With these exceptions, the construction of the pumping chamber, impellers and diffusers of the embodiment of FIGS. 1 and 2 is conventional.

Figure 3:
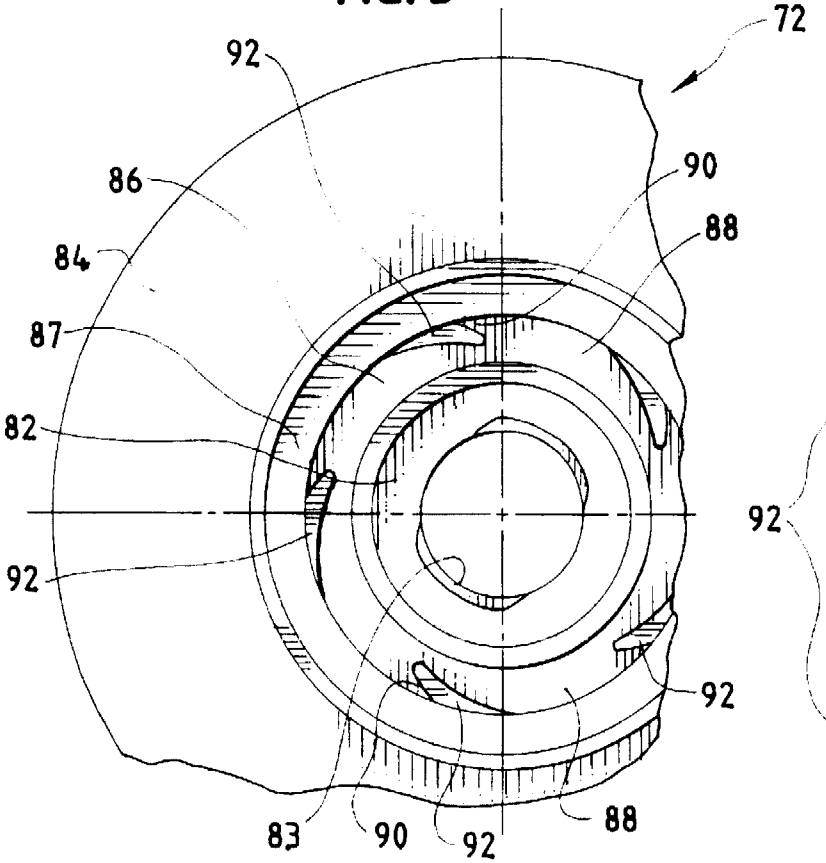
FIG. 3 is a fragmentary front view of an impeller used in the pump of FIG. 1, showing the inner ends of the outwardly spiralling vanes within the interior of the impeller.

FIG. 3 is a fragmentary front view of impeller 72 in the pump of FIGS. 1 and 2. Hub 82, at the center of the impeller, is threaded at 83 for attachment to the pump shaft. Circular front wall 84, extending outward from the hub, defines central opening or eye 86. Front wall 84 also defines ledge 87 to receive the inner portion of protective liner 62.

Circular rear shroud 88 can be seen through eye 86 in this Figure. Impeller passages 90 are also seen through eye 86. The inner tips of vanes 92, which vanes spiral outward toward the outer periphery of the impeller and in the direction of rotation of the pump shaft are seen, again through the impeller eye, protruding beyond the rear shroud.

Figure 4:
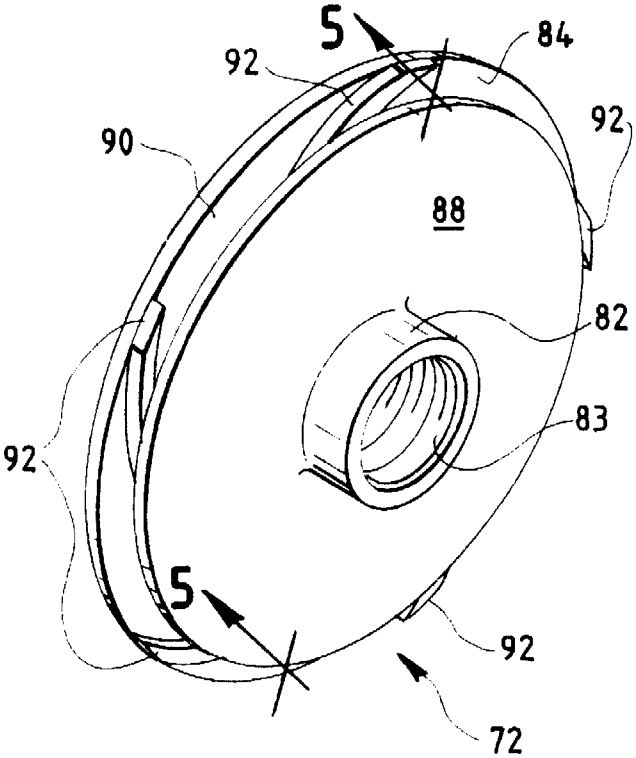
FIG. 4 is a three-quarters isometric view of the impeller of FIG. 2, on a somewhat reduced scale, as seen from the rear side of the impeller, showing the outer ends of the outwardly spiralling vanes within the interior of the impeller.

FIG. 4 is a tilted, isometric view (on a slightly reduced scale) of impeller 72, showing front wall 84 and rear shroud 88, with spiralling vanes 92 positioned between them to define impeller passages 90. Front wall 84 and the vanes forming passages 90 extend farther outward than the rear shroud.

Figure 5:
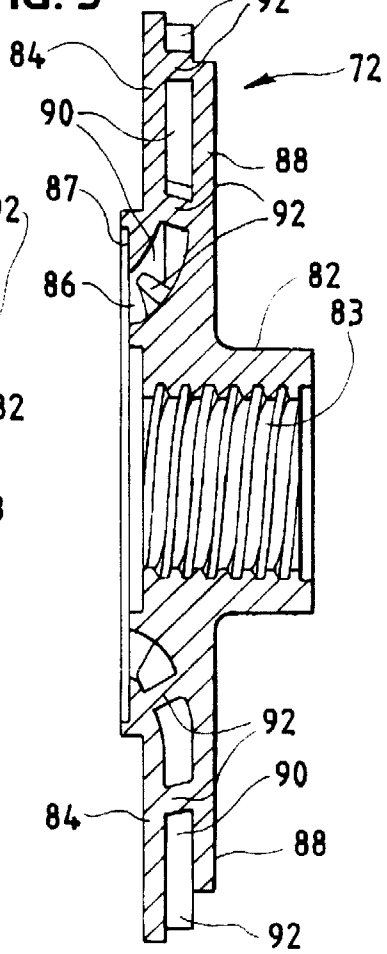
FIG. 5 is a cross-sectional view of the impeller shown in FIG. 3, taken along line 5—5 in the latter Figure.

FIG. 5 is a slightly enlarged cross-sectional view of the impeller shown in FIG. 4, taken along line 5—5 in the latter Figure. In this Figure, eye 86 leads to impeller passages 90, which are formed by outwardly spiralling vanes 92. Both the side walls and cross sections of the vanes are seen.

Figures 6, 7, 8:
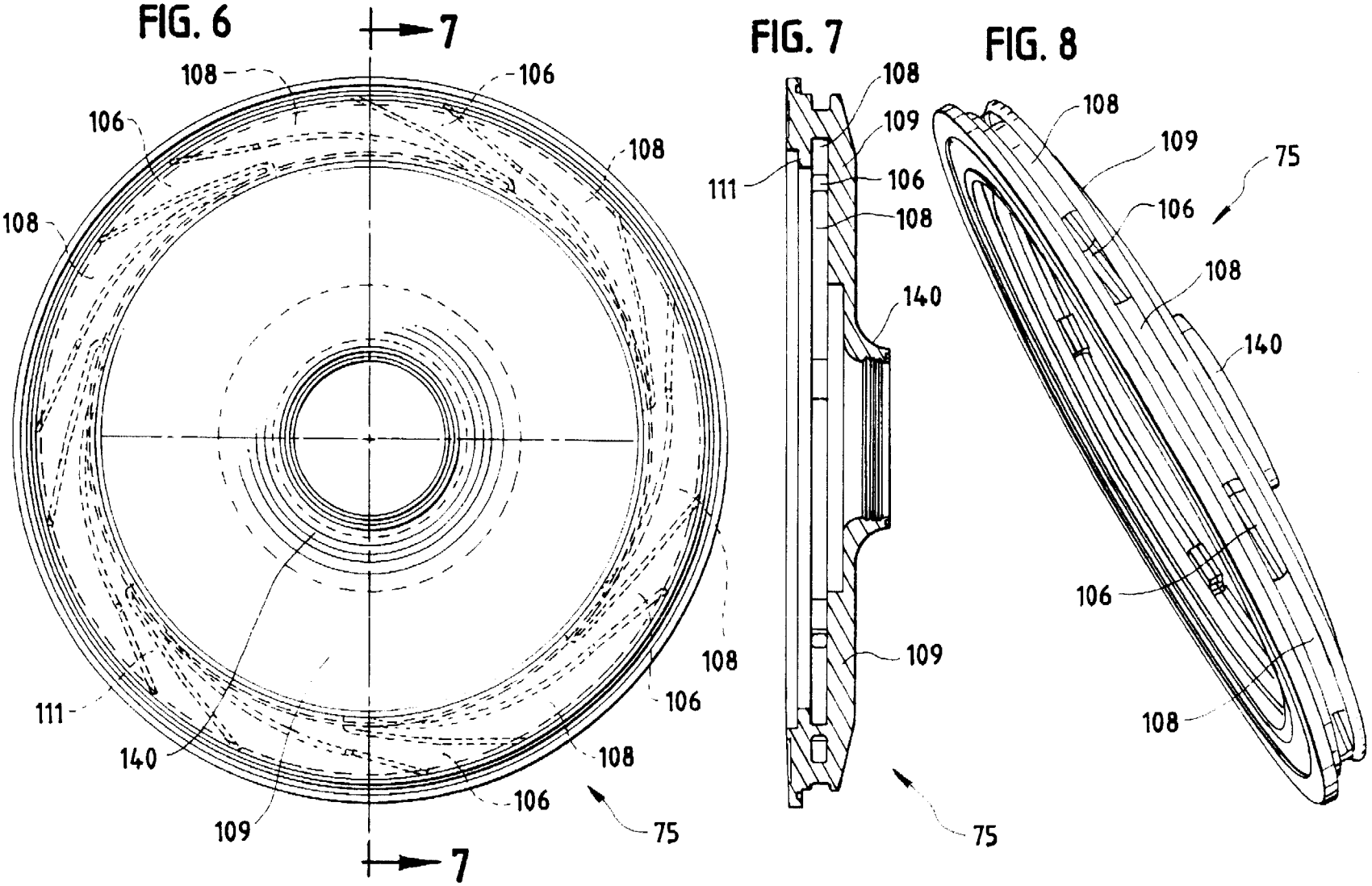
FIG. 6 is a rear view of the initial portion of a diffuser used in the pump of FIG. 1, showing in dashed lines the inwardly spiralling vanes of this diffuser portion.
FIG. 7 is a vertical cross section of the diffuser portion shown in FIG. 6, taken along line 7—7 in the latter Figure.
FIG. 8 is an isometric view of the diffuser portion shown in FIG. 6, after it has been rotated clockwise approximately 100° around its vertical axis and has been tilted to the left to a point approximately 60° to the plane of the drawing.

FIG. 6 is a rear view of first portion 75 of diffuser 74. Diffuser first portion 75 has a central hub 140. Inwardly spiralling vanes 108 (shown in dashed lines because obscured by rear wall 109) define initial portions 106 of the diffuser passages (also shown in dashed lines).

FIG. 7 is a vertical cross section of the diffuser portion shown in FIG. 6, taken along line 7—7 in the latter Figure. This Figure shows the first portions 106 of the inwardly spiralling diffuser passages, formed by vanes 108 which are located between rear wall 109 and diffuser reentrant flange 111, which are located on either side of each passage.

FIG. 8 is an isometric view of the diffuser portion shown in FIG. 6, after it has been rotated clockwise approximately 100° around its vertical axis and has been tilted to the left to a point approximately 60° to the plane of the drawing. This Figure again shows the initial portion of diffuser passages 106 defined by inwardly spiralling vanes 108.

Figure 9:
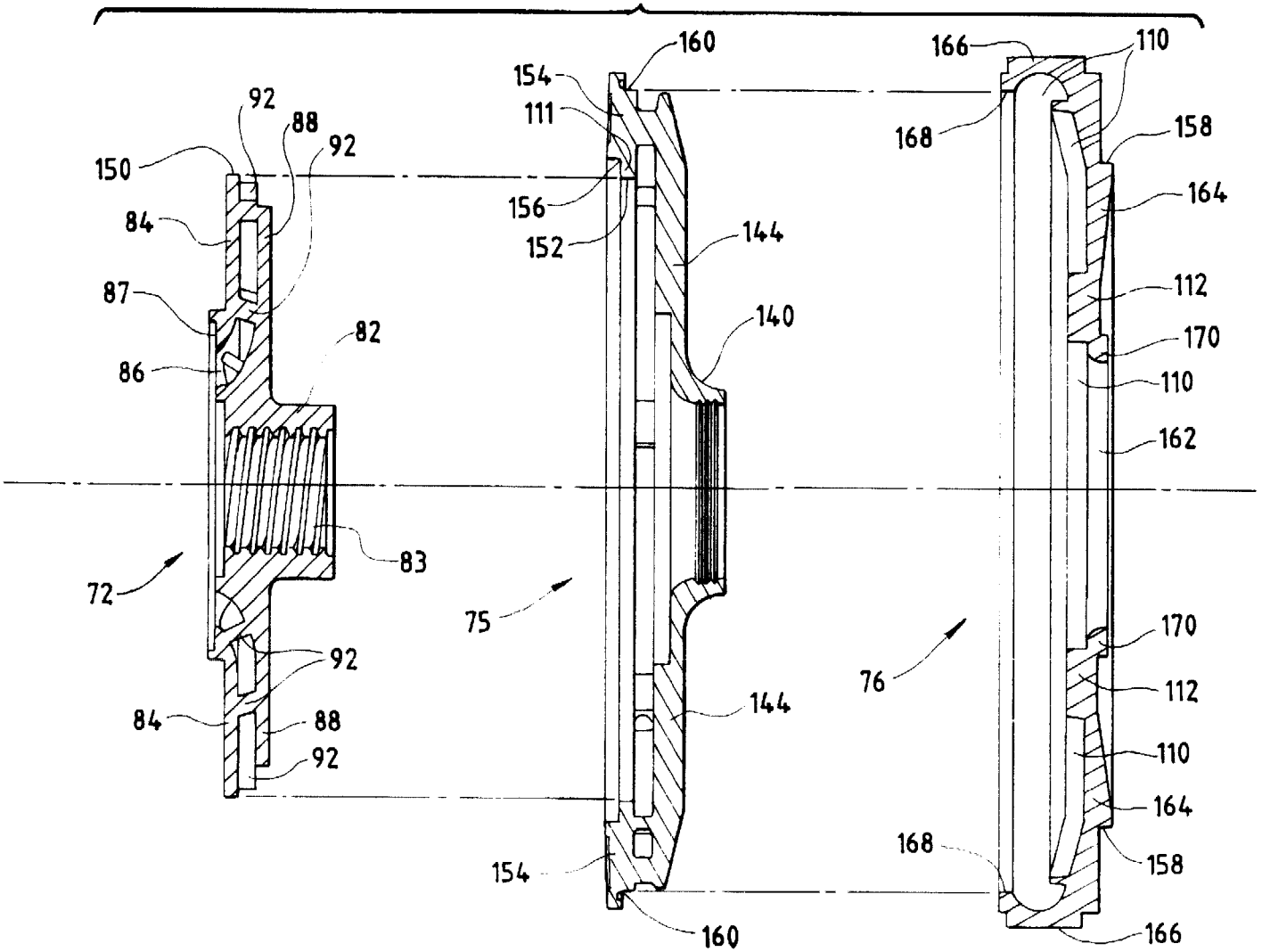
FIG. 9 is an exploded view showing in cross section the impeller, the initial portion of the diffuser, and the return portion of the diffuser that together make up the modular pumping unit at each stage of the multi-stage centrifugal pump of FIG. 1.

FIG. 9 is an exploded view showing in cross section impeller 72, initial portion 75 of diffuser 74, and return portion 76 of the diffuser, which together make up the modular pumping unit at each stage of the multi-stage centrifugal pump of FIGS. 1 and 2.

When these three members are assembled to form a modular pumping unit, outer end portion 150 of front wall 84 of impeller 72 (on the left-hand side of FIG. 9) fits within inner edge 152 of inwardly extending flange 111 of first member 75 of the diffuser. Hub 82 of the impeller extends to the rear through hub 140 of diffuser first portion 75 and hole 162 of return portion 76 of the diffuser.

Outer portion 154 of diffuser portion 75 is notched at 156 to form a face-to-face contact with an inwardly extending circular ridge on the end wall at the low pressure end of the pumping chamber, when the diffuser is in the first modular pumping unit, and to engage notch 158 on return member 76 when the diffuser is in the next succeeding modular pumping unit.

Return member 76 is generally in the shape of a shallow bowl, with opening 162 in the center of the bowl. Diffuser passages 110 are formed by return wall 164 and wall 144 of first diffuser member 75, together with spiralling vanes 112.

Side wall 166 of bowl-like member 104 extends toward the low pressure end of the pumping chamber, and partially overhangs outer end wall 154 of first diffuser member 75. Edge portion 168 of side wall 166 forms a face-to-face contact with notch 160 in outer wall 154 of first diffuser member 75. Wall 164 of return 76 is configured at 170 to form a sliding, circular grooved engagement with ledge 87 on front wall 84 of impeller 72 in the next adjacent modular pumping unit to the right from the unit shown in FIG. 9.

While this invention has been described in connection with the best mode presently contemplated by the inventor for carrying out his invention, the preferred embodiment described and shown is for purposes of illustration only, and is not to be construed as constituting any limitation of the invention. Modifications will be obvious to those skilled in the art, and all modifications that do not depart from the spirit of the invention are intended to be included within the scope of the appended claims.

We claim:

1. A centrifugal pump for use in high pressure slurry pumping, which comprises:

(a) a pump shaft;

(b) a motor operatively connected to the pump shaft;

(c) a pumping chamber containing a centrifugal impeller and a non-rotatable diffuser, the impeller being secured to the pump shaft to rotate with the shaft, and being configured to direct liquid passing through it outwardly and in the direction of rotation of the shaft, to exit from the impeller at a greater velocity and greater pressure than the velocity and pressure at which the liquid entered the impeller, the diffuser being configured to direct liquid inward toward the pump shaft to exit from the outlet of the diffuser at a lower velocity and higher pressure than the velocity and pressure at which the liquid entered the diffuser, the impeller and diffuser being formed of hard chrome iron; and (d) a high pressure containment shell radially spaced from the impeller and diffuser, the resulting space having the general shape of a thin-walled hollow cylinder and being in fluid communication with the interior of the diffuser.

2. A centrifugal pump according to claim 1 which includes a plurality of impellers and an equal number of diffusers, a diffuser being located on the rear side of each impeller.

3. A centrifugal pump for use in high pressure slurry pumping, which comprises:

(a) a support frame;

(b) a generally cylindrical pumping chamber mounted on the support frame, the end wall at the low pressure end of the chamber defining an inlet opening for introduction of the liquid being pumped, and the end wall at the high pressure end of the chamber defining an opening for discharge of the liquid;

(c) a pump shaft mounted on the support frame with one portion positioned within the pumping chamber and one portion extending from the chamber and terminating in a power end;

(d) a motor having its drive shaft operatively connected to the power end of the rotatable pump shaft;

(e) a centrifugal impeller having a hub secured to the pump shaft to rotate with the shaft, a circular front wall extending outward from the hub and defining a central inlet opening adjacent the hub, a circular rear shroud spaced axially from the front wall and extending outward from the hub, a plurality of impeller passages located between the front wall and rear shroud in fluid communication with the central inlet opening, each of said passages extending outward toward the outer periphery of the impeller in the direction of rotation of the pump shaft and being configured to direct liquid outward to exit from the passage at a greater velocity and greater pressure than the velocity and pressure at which the liquid entered the passage, and (f) a diffuser fixedly mounted within the pumping chamber on the rear side of the impeller, said diffuser including a plurality of passages extending inward toward the center of the diffuser in the direction of rotation of the pump shaft, with their outer ends in fluid communication with the impeller passages, each passage being configured to direct liquid inward toward the pump shaft to exit from the outlet of the passage at a lower velocity and higher pressure than the velocity and pressure at which the liquid entered the passage, and being configured to direct the liquid toward the discharge opening in the pumping chamber end wall, the impeller and diffuser each being formed of hard chrome iron, and (g) a high pressure containment shell (i) having a liquid-tight connection with the end wall of the pumping chamber at each end of the chamber, and (ii) being radially spaced from the impeller and diffuser, (iii) the resulting space being in fluid communication with the interior of the diffuser.

4. A centrifugal pump according to claim 3 in which said resulting space is in direct fluid communication, at a location at least about 50 percent of the distance along the liquid flow path through the pump, with the interior of the diffuser.

5. A centrifugal pump according to claim 3 in which said resulting space is in fluid communication, through the space immediately outside the outlets of the diffuser passages, with the interior of the diffuser.

6. A centrifugal pump according to claim 4 or 5 in which the diffuser includes (a) a first member defining the initial portions of said passages in the diffuser, and (b) a return member defining the final portions of the passages in the diffuser, said return member being located on the rear side of the first member, the passages in the first member and the passages in the return member being in fluid communication with each other, said return member being configured to direct the liquid flowing through it toward the discharge opening in the high pressure end wall of the pumping chamber.

7. A centrifugal pump according to claim 4 or 5 in which the impeller is threadably secured to the pump shaft.

8. A multi-stage centrifugal pump for use in high pressure slurry pumping, which comprises:

(a) a support frame;

(b) a generally cylindrical pumping chamber mounted on the support frame, the end wall at the low pressure end of the chamber defining an inlet opening for introduction of the liquid being pumped, and the end wall at the high pressure end of the chamber defining an opening for discharge of the liquid;

(c) a pump shaft mounted on the support frame with one portion positioned within the pumping chamber and one portion extending from the chamber and terminating in a power end;

(d) a motor having its drive shaft operatively connected to the power end of the rotatable pump shaft;

(e) a plurality of pumping stages comprising a series of modular pumping units mounted along the pump shaft within the pumping chamber, the first of said units being positioned at the low pressure end of the chamber and the last being positioned at the high pressure end, each of the pumping units including a rotatable centrifugal impeller and a nonrotatable diffuser that is located on the rear side of the impeller, each of the impellers having a hub secured to the pump shaft to rotate with the shaft, a circular front wall extending outward from the hub and defining a central inlet opening adjacent the hub, a circular rear shroud spaced axially from the front wall and extending outward from the hub, and a plurality of impeller passages located between the front wall and rear shroud in fluid communication with the central inlet opening, each of said passages extending outward toward the outer periphery of the impeller in the direction of rotation of the pump shaft and being configured to direct liquid outward to exit from the passage at a greater velocity and greater pressure than the velocity and pressure at which the liquid entered the passage, each of the diffusers being fixedly mounted within the pumping chamber and including a plurality of passages that are in fluid communication with the impeller passages and extend inward toward the center of the diffuser in the direction of rotation of the pump shaft, each passage being configured to direct liquid inward to exit from the passage at a lower velocity and higher pressure than the velocity and pressure at which the liquid entered the passage, and, except for the passages in the diffuser in the last of the series of pumping units, configured to direct the liquid to the central inlet opening of the impeller of the next succeeding pumping unit, the passages in the last diffuser in the series of pumping units being configured to direct the liquid to the discharge opening in the pumping chamber end wall, all the impellers and diffusers being formed of hard chrome iron; and (f) a high pressure containment shell (i) having a liquid-tight connection with the end wall of the pumping chamber at each end of the chamber, and (ii) being radially spaced from the modular pumping units, (iii) with the resulting space between the pumping units and the containment shell having the general shape of a thin-walled hollow cylinder and being in fluid communication with the interiors of the modular pumping units of the pump.

9. A multi-stage centrifugal pump according to claim 8 in which the space between the pumping units and the containment shell is in direct fluid communication, at a location at least about 50 percent of the total distance along the flow path through the pumping units from the inlet opening of the first unit of the series to the discharge opening in the pumping chamber end wall, with the interiors of the modular pumping units of the pump.

10. A multi-stage centrifugal pump according to claim 8 in which the space between the pumping units and the containment shell is in fluid communication, through the space immediately outside the outlet from the last pumping unit in the series of units, with the interiors of the modular pumping units of the pump.

11. A multi-stage centrifugal pump according to claim 8 or 10 in which (a) the impeller passages between the front wall and rear shroud of each impeller are formed by a plurality of vanes spiralling outward toward the outer periphery of the impeller and in the direction of rotation of the pump shaft, and (b) the passages in each diffuser are formed by a plurality of vanes spiralling inward toward the inner portion of the diffuser and in the direction of rotation of the pump shaft.

12. A multi-stage centrifugal pump according to claim 8 or 10 in which each of the diffusers includes (a) a first member defining the initial portions of said passages in the diffuser, and (b) a return member defining the final portions of the passages in the diffuser, said return member being located on the rear side of the diffuser, the passages in the first member and the passages in the return member being in fluid communication with each other, each of said return members except the return in the last pumping unit of the series being configured to direct the liquid that is flowing through it to the central inlet opening in the impeller of the next succeeding pumping unit, the return in the last pumping unit in the series being configured to direct the liquid to the discharge opening in the end wall at the high pressure end of the pumping chamber.

13. A multi-stage centrifugal pump according to claim 12 in which each return member is bowl-like in shape, with the side walls of the bowl extending toward the low pressure end of the pumping chamber and overhanging the outer ends of the initial portions of the diffuser passages, the outer edge of the bowl being in face-to-face contact with the passage-defining wall at the front of said first member of the diffuser.

14. A multi-stage centrifugal pump according to claim 8 or 10 in which all the diffusers in the series of modular pumping units of the multi-stage pump are secured in face-to-face relationship by connector bolts operatively connected with the high pressure and low pressure end walls of the pumping chamber.

15. A multi-stage centrifugal pump according to claim 8 or 10 in which all the impellers are threadably secured to the pump shaft.

16. A multi-stage centrifugal pump which comprises:

(a) a support frame;

(b) a generally cylindrical pumping chamber mounted on the support frame, the end wall at the low pressure end of the chamber defining an inlet opening for introduction of the liquid being pumped and including a non-rotatable protective liner extending around the inlet opening of the first impeller in the chamber, and the end wall at the high pressure end of the chamber defining an opening for discharge of the liquid;

(c) a pump shaft mounted on the support frame with one portion positioned within the pumping chamber and one portion extending from the chamber and terminating in a power end;

(d) a motor having its drive shaft operatively connected to the power end of the rotatable pump shaft;

(e) a plurality of pumping stages comprising modular pumping units mounted in a series along the pump shaft within the pumping chamber, the first of said units being positioned at the low pressure end of the chamber and the last being positioned at the high pressure end, each of the pumping units including a rotatable centrifugal impeller and a nonrotatable diffuser that is located on the rear side of the impeller, each of the impellers having a hub threadably secured to the pump shaft to rotate with the shaft while remaining fixed axially with respect to the shaft, a circular front wall extending outward from the hub and defining a central inlet opening adjacent the hub, a circular rear shroud spaced axially from the front wall and extending outward from the hub, and a plurality of impeller passages located between the front wall and rear shroud of the impeller in fluid communication with the central inlet opening, said passages being formed by vanes spiralling outward toward the outer periphery of the impeller in the direction of rotation of the pump shaft and terminating in outlet openings from which liquid exits at a greater velocity and pressure than the velocity and pressure at which the liquid entered the passages, each of the diffusers being fixedly mounted within the pumping chamber and including a first member and a separate return member, the return member being located on the opposite side of the diffuser from the impeller, said two members including a plurality of diffuser passages, said passages being formed by vanes spiralling inward toward the inner portion of the diffuser and in the direction of rotation of the pump shaft, to direct liquid inward to exit from the diffuser at a lower velocity and higher pressure than the velocity and pressure at which the liquid entered the passages, the outlet openings of the impeller passages, the passages in said first diffuser member, and the passages in the return member all being in fluid communication with each other, each return except the return in the last of the series of pumping units being configured to direct the liquid passing through the diffuser to the central inlet opening in the impeller of the next succeeding pumping unit, the return in the last pumping unit in the series being configured to direct the liquid from the diffuser to the discharge opening in the pumping chamber end wall, all of the impellers and diffusers, including the return portions of the diffusers, and the protective liner in the pumping chamber end wall at the low pressure end of the chamber, being formed of hard chrome iron; and (f) a high pressure containment shell (i) having a liquid-tight connection with the end wall of the pumping chamber at each end of the chamber, and (ii) being radially spaced from the modular pumping units, (iii) with the space between the pumping units and the containment shell being in fluid communication, through the space immediately outside the outlet from the last pumping unit in the series of units, with the interiors of the modular pumping units of the pump.

* * * * *